US006220888B1

(12) United States Patent
Correa

(10) Patent No.: US 6,220,888 B1
(45) Date of Patent: Apr. 24, 2001

(54) QUICK DISCONNECT CABLE CONNECTOR DEVICE WITH INTEGRAL BODY AND STRAIN RELIEF STRUCTURE

(75) Inventor: Juan L. Correa, Bayamon, PR (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/344,062

(22) Filed: Jun. 25, 1999

(51) Int. Cl.[7] ..... H01R 13/56
(52) U.S. Cl. ..... 439/445; 439/447
(58) Field of Search ..... 439/445, 447, 439/449, 451

(56) References Cited

U.S. PATENT DOCUMENTS

| | | | | |
|---|---|---|---|---|
| 2,869,102 | * | 1/1959 | Hubbell, Jr. | 439/446 |
| 3,986,765 | * | 10/1976 | Shaffer et al. | 439/447 |
| 4,255,007 | * | 3/1981 | Michaels et al. | 439/447 |
| 4,857,008 | * | 8/1989 | Kee et al. | 439/447 |
| 5,340,330 | * | 8/1994 | Dolson et al. | 439/445 |
| 5,620,335 | * | 4/1997 | Siemon | 439/447 |

* cited by examiner

*Primary Examiner*—Hien Vu

(74) *Attorney, Agent, or Firm*—Michael R. Swartz; Jerry M. Presson

(57) ABSTRACT

A quick disconnect cable connector device includes an elongated body made of a rigid molded material and having opposite first and second ends, and a strain relief structure integrally connected to the first end of the body and made of the same molded material. The body can have a conical-shaped configuration tapering from the second to the first end. The body defines an interior chamber extending between and open at the first and second ends and receiving an end of a cable therethrough from the first to the second end such that the body provides an overmold encasing the end of the cable and supporting at the second end of the body a contact termination on the end of the cable. The strain relief structure includes a framework having an annular shape and forming a passage extending along a longitudinal axis of the framework and aligned with the first end of the body. The framework surrounds and receives through its passage a portion of the cable extending from the first end of the body. The framework has a configuration which distributes away from the cable portion at the first end of the body any bending forces imposed on the cable. The framework has a plurality of windows defined therethrough and spaced apart from each other which provide bending flexibility to the strain relief structure sufficient to aid in the distribution of bending forces away from the cable portion at the first end of the body.

16 Claims, 1 Drawing Sheet

QUICK DISCONNECT CABLE CONNECTOR DEVICE WITH INTEGRAL BODY AND STRAIN RELIEF STRUCTURE

BACKGROUND OF THE INVENTION

1. Field of the Invention

The present invention generally relates to cable connector devices and, more particularly, is concerned with a quick disconnect cable connector device having an integral body and strain relief structure.

2. Description of the Prior Art

Cables, such as coaxial cables and the like, are used in a variety of situations. Ends of these cables often must be connected to one another and to contact terminations on various equipment, such as television sets. Various cable connector devices have been developed over the years for this purpose. Quick disconnect cable connector devices, such as those designed, manufactured and marketed by Hubbell Incorporated, allow for easy connecting and disconnecting of the ends of cables. A typical quick disconnect cable connector device includes a coupling member which is mounted to an end of a cable. The coupling member includes contact terminations which are connected to the end of the cable. The coupling member and the contact terminations thereof have either mateable male or female configurations. The coupling member of one device in the male configuration is fastenable to the coupling member of another device in the female configuration. In such manner, the ends of the cables may be connected to and disconnected from one another and other contact terminations.

While the prior art quick disconnect cable connector devices appear to be generally satisfactory for use under the specific conditions for which they were designed, it is perceived by the inventors herein that improvements are still needed in the case of such devices in terms of their durability, ergonomics and ease of use. Consequently, a need remains for innovations in the design of quick disconnect cable connector devices.

SUMMARY OF THE INVENTION

The present invention provides a quick disconnect cable connector device which is designed to satisfy the aforementioned need. The quick disconnect cable connector device of the present invention has an integral body and strain relief structure. The body is substantially rigid for durability. The body has a conical-shaped or elbow-shaped configuration and ribs formed thereon for ease in gripping the body in the process of pushing together and pulling apart male and female coupling members. The strain relief structure has a framework with a configuration that gives support and flexibility to the merger of an end portion of a cable with the rigid body of the device so as to prevent any forces exerted on the cable at its connection with the body from producing a sharp angular bend of the cable relative to the body that could damage the cable and/or its connection with the body.

Accordingly, the present invention is directed to a cable connector device which comprises: (a) an elongated body made of a substantially rigid molded material and having opposite first and second ends, the body defining an interior chamber extending between and open at the first and second ends and receiving an end of a cable therethrough from the first end to the second end of the body such that the body provides an overmold encasing the end of the cable and supporting at the second end of the body a contact termination on the end of the cable; and (b) a strain relief structure integrally connected to the first end of the body and made of the same molded material as the body, the strain relief structure surrounding a portion of the cable extending from the first end of the body and having a configuration which distributes away from the first end of the body any bending forces imposed on the cable portion.

More particularly, in a first embodiment of the device, the body has a substantially conical-shaped configuration with the body tapering from the second end to the first end thereof. The body also has an exterior surface formed circumferentially thereon and extending between the first and second ends of the body. The exterior surface has gripping means thereon which includes a plurality of longitudinal ribs spaced apart circumferentially from one another and extending longitudinally between the first and second ends of the body. The gripping means also includes a pair of circumferential ribs at the second end of the body adjacent to the strain relief structure. In a second embodiment of the device, the body has a substantially elbow-shaped configuration and an exterior surface formed adjacent to the second end of the body. The exterior surface has gripping means thereon which includes a plurality of ribs extending transversely on the body.

The strain relief structure includes a framework having an annular shape defining a longitudinal axis and forming a passage extending along the longitudinal axis and aligned with the first end of the body. The framework receives the portion of the cable through the passage. The framework has a plurality of windows defined therethrough and spaced apart from each other which provide bending flexibility to the strain relief structure sufficient to aid in the distribution of bending forces away from the cable portion at the first end of the body. The windows have transverse dimensions extending circumferentially about the framework and transverse to the longitudinal axis of the framework and also have longitudinal dimensions extending along the longitudinal axis of the framework. The framework also includes a plurality of interconnected support elements defining the windows therebetween. The transverse dimensions of some of the windows differ from the transverse dimensions of other of the windows. Also, the windows are spaced at graduated distances from the first end of the body with the windows spaced farther from the first end of the body having longer longitudinal dimensions than the windows spaced closer to the first end of the body.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
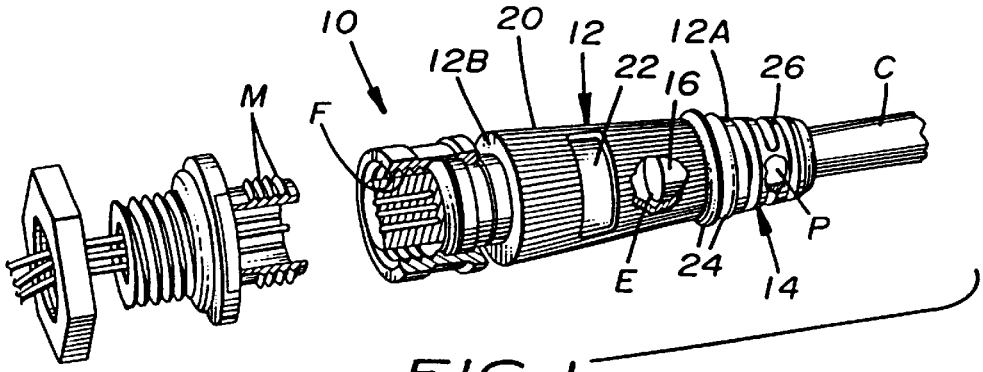
FIG. 1 is an exploded perspective view with portions broken away of a first embodiment of a quick disconnect cable connector device of the present invention showing a body and strain relief structure of the device having a substantially conical-shaped co-axial configuration and male and female coupling members of the device.
Figure 2:
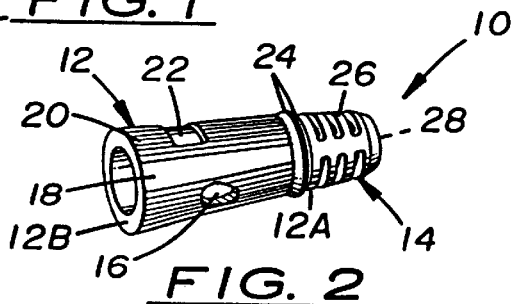
FIG. 2 is a perspective view of the body of the device having the conical-shaped configuration.
Figure 3:
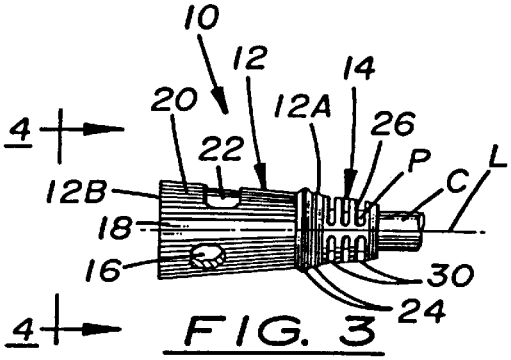
FIG. 3 is a side elevational view of the body of the device of FIG. 2 showing a portion of a cable extending from an end of the body.
Figure 4:
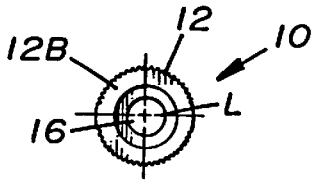
FIG. 4 is an end elevational end view of the body of the device as seen along line 4—4 of FIG. 3.
Figure 5:
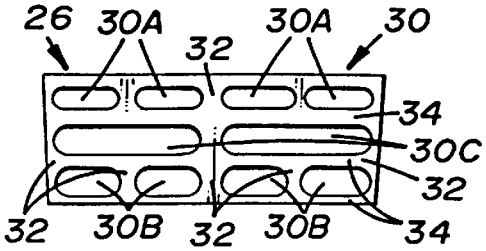
FIG. 5 is a layout of the strain relief structure of the device.

Referring to the drawings and particularly to FIGS. 1 to 3, there is illustrated a first embodiment of a quick disconnect cable connector device, generally designated 10, of the present invention for releasably coupling together mateable conventional male and female contact terminations M, F such as commonly employed on the ends E of coaxial cable C and on equipment to which such cable is connected. Basically, the cable connector device 10 includes an elongated body 12 made of a rigid material, such as a fiberglass reinforced plastic material, and having opposite first and second ends 12A, 12B, and a strain relief structure 14 integrally connected to the first end 12A of the body 12 and made of the same material. The body 12 and strain relief structure 14 can be molded together over the end E of the cable C through employment of conventional injection molding techniques well-known to those of ordinary skill in the art.

Referring to FIGS. 1 to 4, in the first embodiment, the elongated body 12 has a substantially conical-shaped configuration tapering from the second end 12B to the first end 12A. Thus, the body 12 has an outside diameter at the first end 12A which is less than an outside diameter at the second end 12B thereof. Also, the axial length of the body 12 is substantially greater than the outside diameter of the body 12 at its second end 12B. The body 12 defines an interior chamber 16 extending between and open at the first end 12A and second end 12B and receiving the end E of the coaxial cable C therethrough from the first end 12A to the second end 12B such that the body 12 provides an overmold encasing the end E of the cable C and also supports at the second end 12B of the overmold body 12 one of the mateable male and female contact terminations M, F on the end E of the cable C.

The body 12 also has an exterior surface 18 circumferentially encircling the body 12 and having suitable gripping means formed thereon. In one preferred form, the gripping means on the exterior surface 18 includes a plurality of longitudinal ribs 20 spaced apart circumferentially and extending longitudinally between the first end 12A and the second end 12B of the body 12. A portion of the longitudinal ribs 20 can be interrupted at location 22 to provide space for the application of the manufacturer's logo on the exterior surface 18 of the body 12. The gripping means on the exterior surface 18 of the body 12 further includes a pair of circumferential ribs 24 spaced apart from one another, protruding outwardly from said exterior surface 18 and circumferentially extending about said body 12 at said first end 12A thereof and adjacent to said strain relief structure 14. The longitudinal and circumferential ribs 20, 24 give the exterior surface 18 a rough texture but are small in cross-sectional size and thus protrude outwardly only slightly from the exterior surface 18 of the body 12. The rough texture of the ribs 20, 24 and the conical shape of the body 12 provide the device 10 with an ergonomic configuration that aids the user in gripping the device 10 and in pushing and pulling on the device 10 to assist in the process of coupling and decoupling the mateable male and female contact terminations M, F to and from one another.

Referring to FIGS. 1 to 5, the strain relief structure 14 of the cable connector device 10 includes a framework 26 having an annular shape and forming a passage 28 extending along a longitudinal axis L of the framework 26 and aligned with the first end 12A of the body 12. The framework 26 surrounds and receives through the passage 28 thereof a portion P of the cable C extending from the first end 12A of the body 12. The framework 26 has a configuration which distributes away from the cable portion P at the first end 12A of the body 12 any bending or other forces imposed on the cable C.

More particularly, the framework 26 has a plurality of windows 30 defined therethrough and spaced apart from each other which provide some minimal amount of flexibility to the strain relief structure 14 which aids in the distribution of the bending and other forces away from the cable portion P at the first end 12A of the body 12. The windows 30 have transverse dimensions (or lengths) extending circumferentially about the framework 26 and transverse to the longitudinal axis L of the framework 26. The windows 30 also have longitudinal dimensions (or widths) extending along or parallel to the longitudinal axis L of the framework 26. The framework 26 also includes a plurality of interconnected longitudinal and transverse support elements 32, 34 defining the windows 30 therebetween. As can be readily understood in FIG. 5, the transverse dimensions of the windows 30A in an inner row thereof are greater than the transverse dimensions of the windows 30B in an outer row thereof while the transverse dimensions of all windows 30A, 30B in the inner and outer rows thereof are substantially smaller than the transverse dimensions of the windows 30C in a center row thereof. The respective windows 30A, 30C, 30B in the inner, center and outer rows thereof are spaced at graduated distances from the first end 12A of the body 12. The windows 30B of the outer row thereof spaced farther from the first end 12A of the body 12 have longer longitudinal dimensions than the windows 30A, 30C of the inner and center rows thereof which are spaced closer to the first end 12A of the body. The windows 30C of the center row thereof have a longer longitudinal dimension than the windows 30A of the inner row thereof. The configuration of the framework 26, as defined by the interconnected longitudinal and transverse support elements 32, 34 and the windows 30 therebetween, thus eliminates the occurrence of a sharp angular bend of the cable C relative to the body 12 at the end 12A thereof that could damage the cable C and/or its connection with the body 12.

Figure 6:
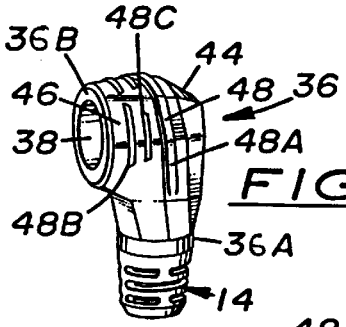
FIG. 6 is a perspective view of a second embodiment of the quick disconnect cable connector device of the present invention showing a body of the device having a substantially elbow-shaped configuration.
Figure 7:
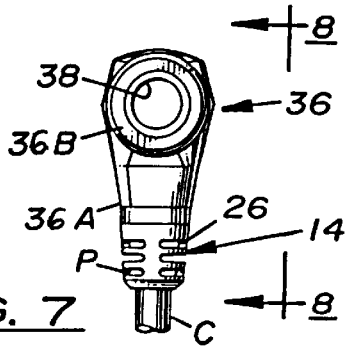
FIG. 7 is a front elevational view of the device of FIG. 6 showing a portion of a cable extending from an end of the body.
Figure 8:
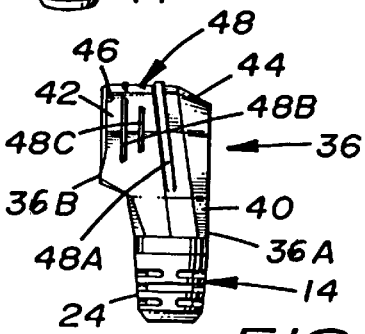
FIG. 8 is a side elevational view of the device as seen along line 8—8 of FIG. 7.

Referring to FIGS. 6 to 8, there is illustrated a second embodiment of the elongated body, designated 36, of the cable connector device 10. The body 36 of the second embodiment is similar to the body 12 of the first embodiment in that the body 36 has opposite first and second ends 36A, 36B and defines an interior chamber 38 open at the first and second ends 36A, 36B. Also, like the body 12, the body 36 receives the end E of the cable C through the first end 36A, the interior chamber 38 and the second end 36B of the body 36 such that the body 36 provides an overmold encasing the end E of the cable C and also supports at the second end 36B of the overmold body 36 one of the mateable male and female contact terminations M, F on the end E of the cable C. The body 36 of the second embodiment has the same integrally connected strain relief structure 14 as described above in association with the body 12 of the first embodiment and both the body 36 and strain relief structure 14 are molded using the same material and through employment of conventional injection molding techniques well-known to those of ordinary skill in the art.

Unlike the body 12 of the first embodiment, the body 36 of the second embodiment has a substantially elbow-shaped configuration. The body 36 has a first leg portion 40 extending interiorly from the first end 36A and a second leg portion 42 extending interiorly from the second end 36B. Each of the first and second leg portions 40, 42 has a substantially cylindrical configuration. The outside diameter of the first leg portion 40 is less than the diameter of the second leg portion 42. The body 36 also has a rear surface portion 44. The rear surface portion 44 is formed generally at the juncture of the first and second leg portions 40, 42. The rear surface portion 44 is substantially flat and assists the user in pushing on the body 12 in mateably coupling the male and female contact terminations M, F to one another.

The body 36 also has an exterior surface 46 formed on second leg portion 42 adjacent to the second end 36B of the body 36. The exterior surface 46 has gripping means thereon which includes a plurality of ribs 48. The ribs 48 extend transversely on the body 36, particularly, on top and opposite sides of the second leg portion 42 and are spaced from the second end 36B of the body 36. The gripping ribs 48 preferably are three in number and extend in spaced apart generally parallel relationship to one another. The rib 48A disposed farthest from the second end 36B of the body 36 is continuous on the top and opposite sides of the second leg portion 42. The ribs 48B and 48C disposed progressively closer to the second end 36B of the body 36 are interrupted at two locations where the top and opposite sides of the second leg portion 42 come together. The rib 48B is farther from the second end 36B than is the rib 48C. Each of the ribs 48B, 48C have sections on each of the top and opposite sides of the second leg portion 42. The rib 48A protrudes outwardly from the exterior surface 46 slightly farther than each of the ribs 48B, 48C, but all of the ribs 48 are small and do not protrude to a substantial degree. The ribs 48 give the user finger holds in pushing and pulling the body 36 in the process of coupling and decoupling the mateable male and female contact terminations M, F to and from one another.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

What is claimed is:

1. A cable connector device, comprising:

(a) an elongated body made of a substantially rigid molded material and having opposite first and second ends, said body defining an interior chamber extending between and open at said first and second ends and receiving an end of a cable therethrough from said first end to said second end of said body, said body encasing the end of the cable and supporting at said second end of said body a contact termination on the end of the cable, said body having an exterior surface formed circumferentially thereon and gripping means on said exterior surface including a plurality of ribs spaced apart circumferentially from one another and extending longitudinally between said first and second ends of said body and protruding outwardly from said exterior surface of said body; and (b) a strain relief structure integrally formed on said first end of said body and made of the same molded material as said body, said strain relief structure surrounding a portion of the cable extending from said first end of said body, said strain relief structure having a framework which distributes any bending forces imposed on the cable portion away from said first end of said body, said framework having an annular shape defining a longitudinal axis and forming a passage extending along said longitudinal axis and aligned with said first end of said body for receiving the portion of the cable through said passage, said framework including a plurality of spaced-apart windows defined therethrough and formed by a plurality of interconnected support elements, said windows having transverse dimensions extending circumferentially about said framework and transverse to said longitudinal axis of said framework and longitudinal dimensions extending along said longitudinal axis of said framework, said windows being disposed in transverse rows spaced at different longitudinal distances from said first end of said body with an inner row of said windows being at a distance closer to said first end of said body than an outer row of said windows, the transverse dimensions of said windows in said inner row thereof being greater than the transverse dimensions of said windows in said outer row thereof while the transverse dimensions of all said windows in said inner and outer rows thereof being substantially smaller than the transverse dimensions of said windows in a center row thereof which is disposed between said inner and outer rows.

2. The device as recited in claim 1, wherein said gripping means on said exterior surface of said body further includes a pair of ribs spaced apart from one another, protruding outwardly from said exterior surface and extending circumferentially about said body at said first end thereof and adjacent to said strain relief structure.

3. The device as recited in claim 1, wherein said body has a substantially elbow-shaped configuration.

4. The device as recited in claim 3, wherein said body has an exterior surface formed adjacent to said second end of said body and having gripping means thereon.

5. The device as recited in claim 4, wherein said gripping means on said exterior surface of said body includes a plurality of ribs extending transversely on said body.

6. The device as recited in claim 1, wherein said windows are spaced at graduated distances from said first end of said body with said windows spaced farther from said first end of said body having longer longitudinal dimensions than said windows spaced closer to said first end of said body.

7. The device as recited in claim 1, wherein said respective windows in said inner, center and outer rows thereof are spaced at graduated distances from said first end of said body.

8. The device as recited in claim 7, wherein said windows of said outer row thereof are spaced farther from said first end of said body and have longer longitudinal dimensions than said windows of said inner and center rows thereof which are spaced closer to said first end of said body.

9. The device as recited in claim 8, wherein said windows of said center row thereof have longer longitudinal dimensions than said windows of said inner row thereof.

10. A cable connector device, comprising:

(a) an elongated body made of a substantially rigid molded material and having opposite first and second ends, said body having a substantially conical-shaped configuration with said body tapering from said second end to said first end thereof, said body defining an interior chamber extending between and open at said first and second ends and receiving an end of a cable therethrough from said first end to said second end of said body, said body encasing the end of the cable and supporting at said second end of said body a contact termination on the end of the cable, said body having an exterior surface formed circumferentially thereon and gripping means on said exterior surface including a plurality of ribs spaced apart circumferentially from one another and extending longitudinally between said first and second ends of said body and protruding outwardly from said exterior surface of said body; and (b) a strain relief structure integrally formed on said first end of said body and made of the same molded material as said body, said strain relief structure including a framework having an annular shape defining a longitudinal axis and forming a passage extending along said longitudinal axis and aligned with said first end of said body, said framework surrounding and receiving through said passage a portion of the cable extending from said first end of said body, said framework being formed so as to distribute away from said first end of said body any bending forces imposed on the cable portion, said framework including a plurality of spaced-apart windows defined therethrough and formed by a plurality of interconnected support elements, said windows having transverse dimensions extending circumferentially about said framework and transverse to said longitudinal axis of said framework and longitudinal dimensions extending along said longitudinal axis of said framework, said windows being disposed in transverse rows spaced at different longitudinal distances from said first end of said body with an inner row of said windows being at a distance closer to said first end of said body than an outer row of said windows, the transverse dimensions of said windows in said inner row thereof being greater than the transverse dimensions of said windows in said outer row thereof while the transverse dimensions of all said windows in said inner and outer rows thereof being substantially smaller than the transverse dimensions of said windows in a center row thereof which is disposed between said inner and outer rows.

11. The device as recited in claim 10, wherein said framework has a plurality of windows defined therethrough and spaced apart from each other which provide bending flexibility to said strain relief structure sufficient to aid in the distribution of bending forces away from the cable portion at said first end of said body, said windows having transverse dimensions extending circumferentially about said framework and transverse to said longitudinal axis of said framework, said windows also having longitudinal dimensions extending along said longitudinal axis of said framework.

12. The device as recited in claim 11, wherein said framework includes a plurality of interconnected support elements defining said windows therebetween.

13. The device as recited in claim 11, wherein said transverse dimensions of some of said windows differ from said transverse dimensions of other of said windows.

14. The device as recited in claim 6, wherein said windows are spaced at graduated distances from said first end of said body with said windows spaced farther from said first end of said body having longer longitudinal dimensions than said windows spaced closer to said first end of said body.

15. The device as recited in claim 6, wherein said body has an exterior surface formed circumferentially thereon and extending between said first and second ends of said body, said exterior surface having gripping means thereon.

16. The device as recited in claim 15, wherein said gripping means on said exterior surface of said body includes a plurality of ribs spaced apart circumferentially from one another and extending longitudinally between said first and second ends of said body.

* * * * *